US008374661B2

(12) United States Patent
Fratti et al.

(10) Patent No.: US 8,374,661 B2
(45) Date of Patent: Feb. 12, 2013

(54) RECESSIBLE INTEGRATED POCKET CLIP FOR MOBILE DEVICES AND THE LIKE

(75) Inventors: Roger A. Fratti, Mohnton, PA (US); Douglas D. Lopata, Boyertown, PA (US); Lawrence A. Rigge, Emmaus, PA (US)

(73) Assignee: Agere Systems LLC, Allentown, PA (US)

( * ) Notice: Subject to any disclaimer, the term of this patent is extended or adjusted under 35 U.S.C. 154(b) by 254 days.

(21) Appl. No.: 12/743,035

(22) PCT Filed: Dec. 18, 2007

(86) PCT No.: PCT/US2007/087860

§ 371 (c)(1),
(2), (4) Date: May 14, 2010

(87) PCT Pub. No.: WO2009/078863

PCT Pub. Date: Jun. 25, 2009

(65) Prior Publication Data

US 2010/0267431 A1 Oct. 21, 2010

(51) Int. Cl.
*H04M 1/00* (2006.01)

(52) U.S. Cl. ..... 455/575.6; 455/575.1; 455/90.3; 455/128; 455/347; 224/669; 224/462

(58) Field of Classification Search .... 455/575.1–575.6, 455/90.3, 128, 347; 224/669, 462
See application file for complete search history.

(56) References Cited

U.S. PATENT DOCUMENTS

| | | | | |
|---|---|---|---|---|
| 6,726,106 | B1 * | 4/2004 | Han et al. | 235/472.01 |
| 2004/0129746 | A1 | 7/2004 | Lee et al. | |
| 2004/0132343 | A1 * | 7/2004 | Bisplinghoff | 439/638 |
| 2005/0002519 | A1 | 1/2005 | Goldberg | |
| 2006/0073819 | A1 * | 4/2006 | Lowles | 455/418 |
| 2006/0113985 | A1 | 6/2006 | Gist et al. | |
| 2007/0096933 | A1 * | 5/2007 | Enitan et al. | 340/686.6 |

FOREIGN PATENT DOCUMENTS

| | | | |
|---|---|---|---|
| CN | 2744078 | Y | 11/2005 |
| DE | 43 10 602 | C1 | 5/1994 |
| GB | 1 514 832 | A | 6/1978 |
| JP | 10133273 | A | 5/1998 |
| JP | 11136329 | A | 5/1999 |
| JP | 2000224276 | A | 8/2000 |

(Continued)

OTHER PUBLICATIONS

PCT International Search Report and the Written Opinion dated Sep. 30, 2008, for International Application No. PCT/US2007/087860.

(Continued)

*Primary Examiner* — Wayne Cai
(74) *Attorney, Agent, or Firm* — Mendelsohn, Drucker & Associates, P.C.; Kevin M. Drunker; Steve Mendelsohn

(57) ABSTRACT

In one embodiment, an apparatus comprising a housing and a fastener, such as a clip (101, 201) for fastening the apparatus (100, 200) to an article of clothing. The housing (102, 202) has a recess (103, 203) formed therein, such that at least a portion of the fastener is adapted to fit within the recess. The fastener is adapted to travel slidably within the recess (103, 203) between a first position in which the fastener enables the apparatus (100, 200) to be fastened to an external object and a second position in which the fastener is stowed away.

18 Claims, 5 Drawing Sheets

FOREIGN PATENT DOCUMENTS

| | | | |
|---|---|---|---|
| JP | 2002182692 | A | 6/2002 |
| JP | 2002374340 | A | 12/2002 |

OTHER PUBLICATIONS

Chinese Office Action; Mailed Jul. 3, 2012 for the corresponding CN Application No. 200780101961.

Japanese Reason for Refusal; Mailed Jul. 9, 2012 for corresponding JP Application No. 2010-539400.

Chinese Office Action; Mailed Nov. 28, 2012 for corresponding CN Application No. 200780101961.

* cited by examiner

RECESSIBLE INTEGRATED POCKET CLIP FOR MOBILE DEVICES AND THE LIKE

BACKGROUND OF THE INVENTION

1. Field of the Invention

The present invention relates to portable devices, and, in particular, to a pocket clip that can be integrated into the housing of a portable device.

2. Description of the Related Art

With the rise of the use of mobile communication devices, many individuals are now using devices such as mobile telephones, personal digital assistants (PDAs), handheld and palmtop computers, email and web appliances, and other communications, information-processing, and/or storage devices (collectively, "mobile devices").

When a mobile device is not in use, the user typically places the device in a pocket or purse to carry it around. Some users attach their mobile devices to a separate holster or sleeve component that clips to a belt or pant waistline for storage. Some mobile devices include a clip or other fastener as part of the housing of the mobile device, typically on the back of the device, so that a user may directly attach or clip the mobile device to his or her clothing, belt, or purse.

However, increased girth of the mobile device attributable to the clip and/or holster protruding from the housing can make gripping and using the device cumbersome and awkward.

SUMMARY OF THE INVENTION

Problems in the prior art are addressed in accordance with the principles of the present invention by providing a recessible integrated pocket clip for mobile devices and the like.

In one embodiment, the present invention provides an apparatus comprising a housing and a fastener (such as a clip for fastening the apparatus to an article of clothing). The housing has a recess formed therein, such that at least a portion of the fastener is adapted to fit within the recess. The fastener is adapted to travel slidably within the recess between a first position in which the fastener enables the apparatus to be fastened to an external object and a second position in which the fastener is stowed away.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Figure 1:
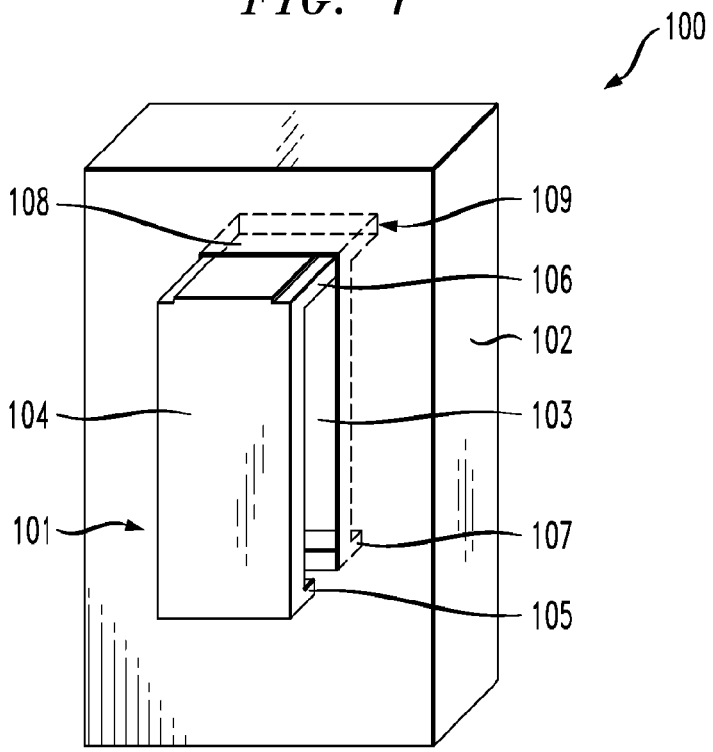
FIG. 1 is a perspective view of a mobile device including a recessible integrated pocket clip consistent with a first embodiment of the present invention, with broken lines showing the contours of a slot formed within the housing, for receiving and engaging the recessible integrated pocket clip.

Referring now to FIG. 1 through FIG. 8, and to FIG. 1 in particular, a mobile device 100 including a recessible integrated pocket clip 101 (the "clip"), consistent with a first embodiment of the present invention is illustrated. Mobile device 100 has a housing 102 having formed therein a recess 103 adapted to receive clip 101, so that the outer face of the elongated portion 104 of clip 101 is flush with housing 102. Clip 101 has a hook 105 at a bottom end of elongated portion 104 and a tab 106 at a top end of elongated portion 104. The contours of recess 103 are formed to match the contours of clip 101. Accordingly, as shown in broken lines within housing 102, a bottom end of recess 103 is formed as a hook area 107 for receiving hook 105, and a top end of recess 103 is formed as a slot 108 for receiving tab 106. A switch 109 may be located within slot 108 for controlling one or more functions of mobile device 100, as will be described in further detail below.

As will be described in further detail below, tab 106 is sufficiently smaller than the open area defined by slot 108 and is slidably disposed within slot 108 to permit clip 101 to travel between a position in which clip 101 is stowed-away, i.e., recessed within housing 102, and a position in which the use of clip 101 is enabled, i.e., clip 101 protrudes from housing 102 to permit mobile device 100 to be fastened to clothing or another external object. Relative translational movement between tab 106 and slot 108, as illustrated by arrow 110 in FIG. 5, moves clip 101 between these two positions. A latch mechanism is operatively associated between tab 106 and slot 108 and includes a tab-latch component 111 (best seen in FIG. 2, FIG. 3, and FIG. 5) on tab 106 and a slot-latch component 112 (best seen in FIG. 4 through FIG. 8) disposed within slot 108. Although FIG. 1 does not show any part of the latch mechanism, FIG. 1 does show slot 108, where slot-latch component 112 and other associated components (best seen in FIG. 4 through FIG. 8) for receiving and engaging tab 106 of clip 101 are located.

Figure 2:
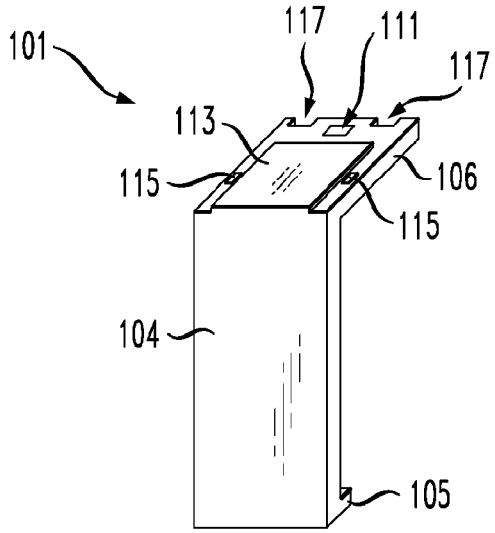
FIG. 2 is a perspective view of the recessible integrated pocket clip of FIG. 1.
Figure 3:
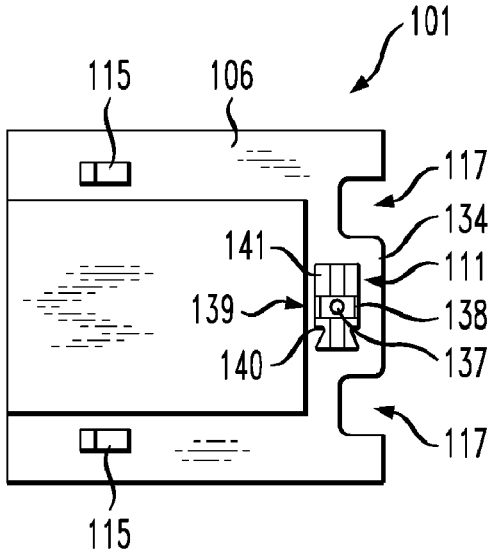
FIG. 3 is a top plan view of the recessible integrated pocket clip of FIG. 1.

FIG. 2 and FIG. 3 are a perspective view and a top plan view, respectively, of clip 101, showing elongated portion 104, hook 105, and tab 106. As shown, tab 106 has a plateau 113 formed thereon for aligning and maintaining tab 106 in a slidable relationship with rails 114 (as shown in FIG. 5). While the details of tab-latch component 111 are not fully visible in FIG. 2, it can be seen that tab-latch component 111 is disposed distally from plateau 113 with respect to elongated portion 104. A pair of protrusions 115 adjacent to and on opposite sides of plateau 113 are located so as to engage lips 116 (shown in FIG. 4 and FIG. 5) to inhibit tab 106 from sliding completely out of slot 108. A pair of recesses 117 are formed in tab 106 to prevent interference with anchor blocks 118 (shown in FIG. 4 and FIG. 5) when clip 101 is in a recessed position.

Figure 4:
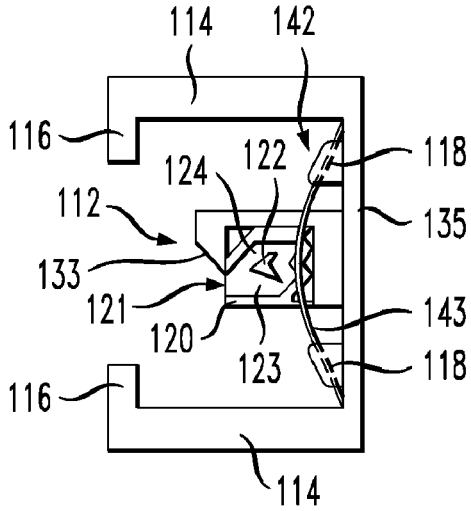
FIG. 4 is a plan view of the slot within the housing and associated components for receiving and engaging the tab of the recessible integrated pocket clip of FIG. 1.
Figure 5:
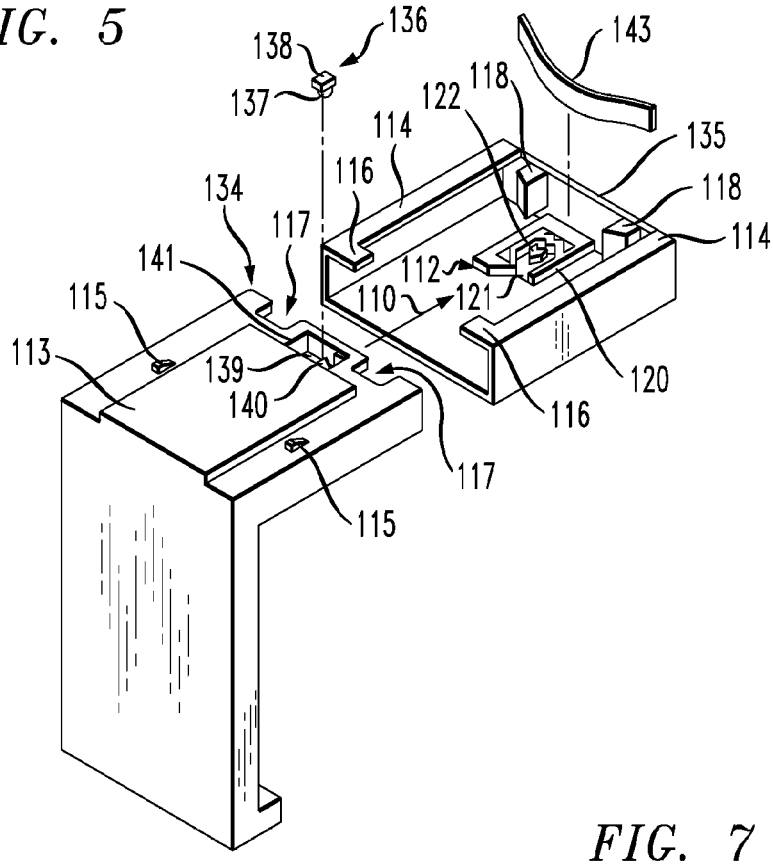
FIG. 5 is an exploded view of the recessible integrated pocket clip of FIG. 1 and the slot of FIG. 4.

Referring now to FIG. 4, it can be seen that slot-latch component 112 is a substantially fixed component disposed within slot 108. The details of slot-latch component 112 are best seen in FIG. 5 through FIG. 8, wherein, for clarity, reference numerals for some components are omitted from some of the drawings, even though the same components are present in all of FIG. 5 through FIG. 8. Slot-latch component 112 includes a generally heart-shaped wall 120 defining a substantially enclosed space except for a single opening or portal 121 provided therein. Within the area confined by wall 120, a somewhat heart-shaped nest 122 is provided. Together with nest 122, and specifically the outer surface thereof, wall 120 defines an entrance track 123 and an exit track 124 leading from and toward portal 121, respectively. A redirector 125 is provided between portions of wall 120 defining entrance and exit tracks 123 and 124. Redirector 125 is operatively positioned with respect to nest 122 to effect latching and unlatching, as will be described in further detail below.

Figure 6:
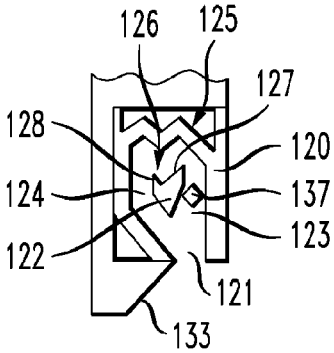
FIG. 6 is a fragmentary view illustrating the latch mechanism being moved from a position in which the clip protrudes to a position in which the clip is recessed.
Figure 7:
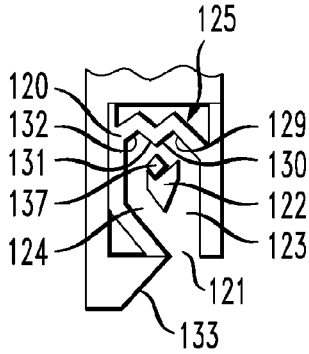
FIG. 7 is a fragmentary view similar to FIG. 6, but illustrating the latch mechanism in a position in which the clip is recessed.
Figure 8:
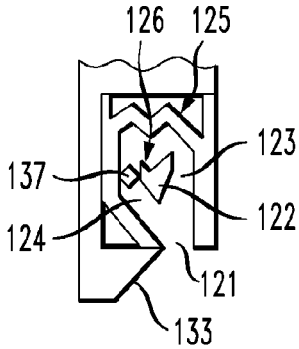
FIG. 8 is a fragmentary view similar to FIG. 6 and FIG. 7, but illustrating the latch mechanism being moved from a position in which the clip is recessed to a position in which the clip protrudes.

Nest 122 (as best seen in FIG. 6 through FIG. 8) is a substantially solid body defining a notch 126 facing redirector 125. Notch 126 has a longer entrance surface 127 and a somewhat shorter exit surface 128, which together form notch 126.

Redirector 125 (as best seen in FIG. 6 through FIG. 8) is a somewhat flattened M-shaped segment of wall 120, with an inner tip or point thereof directed at notch 126 on the inner perimeter of wall 120. Redirector 125 includes an entrance surface 129, a latch-directing surface 130, an unlatch-directing surface 131, and an exit surface 132.

A guide surface 133 is provided at portal 121, to ensure smooth entry of tab-latch component 111 into slot-latch component 112, as will now be described.

Tab-latch component 111 is provided at an inner end 134 of tab 101. Tab-latch component 111 includes a follower 136 substantially fixed in an axial direction relative to tab 106, but translatable in a direction transverse to the axial direction. Thus, follower 136 includes a pin 137 on a sled 138 contained in and slidable along a slot 139. Follower 136 is freely movable along slot 139, from one end 140 of slot 139 to the opposite end 141 thereof.

A biasing mechanism 142 is provided on end 135 and includes a leaf spring 143 secured to anchor blocks 118 on opposite ends thereof. Leaf spring 143 extends over slot-latch component 112 to engage inner end 134 of tab 106.

Tab-latch component 111 and slot-latch component 112 together form a "push-push" mechanism enabling a user to move clip 101 back and forth between a recessed position and a protruding position with successive depressions of clip 101 toward recess 103, as will now be described.

Moving clip 101 to a recessed position with respect to housing 102 occurs as follows. With tab 106 positioned in slot 108, one end 140 of slot 139 is substantially aligned with portal 121 such that, with sled 138 positioned substantially adjacent slot end 140, pin 137 will enter portal 121 as tab 106 is slid into slot 108. Guide surface 133 adjacent portal 121 is angularly disposed relative to the axial direction of slot 108. If sled 138 is positioned away from slot end 140, toward slot end 141, then pin 137 will encounter and slide along guide surface 133, moving follower 136 toward slot end 140 so that pin 137 will enter portal 121. Thus, regardless of the initial position of follower 136 as tab 106 is slid into slot 108, pin 137 will enter portal 121 and move along entrance track 123. This incoming position is illustrated in FIG. 6.

With further relative axial movement of tab 106 with respect to slot 108, pin 137 advances along entrance track 123 until it encounters entrance surface 129 of redirector 125. With still further axial inward movement of tab 106, follower 136 slides along entrance surface 129, thus moving sled 138 away from slot end 140. As tab 106 reaches the fully inserted position, inner end 134 encounters and compresses leaf spring 143, and pin 137 encounters latch-directing surface 130. Since, at this point, clip 101 is fully inserted into recess 103, a user will naturally release clip 101, terminating axially inward pressure on tab 106. Leaf spring 143 urges tab 106 outward slightly, causing pin 137 to slide along and off of latch-directing surface 130 to nest in notch 126. As pin 137 enters notch 126, pin 137 is directed therein also by entrance surface 127 of notch 126, which moves follower 136 still further toward slot end 141. With continued axially outward-biasing force from spring 143, tab 106 is held securely in slot 108, with pin 137 nested in notch 126. This latched position of tab-latch component 111 and slot-latch component 112 is illustrated in FIG. 7. Outward force applied to clip 101, by pulling or the like, will not dislodge pin 137 from notch 126.

To release tab-latch component 111 and slot-latch component 112 from one another and move clip 101 to a protruding position, clip 101 is pushed inward slightly. From the nested position within notch 126, pin 137 is moved outwardly toward redirector 125, encountering unlatch-directing surface 131 and not latch-directing surface 130, as a result of the slight transverse movement of follower 136 as it nested into notch 126. Sliding along unlatch-directing surface 131, follower 136 moves transverse to the axial direction still further toward slot end 141, and pin 137 encounters exit surface 132. With just slight movement, tab 106 is again fully inserted into slot 108, such that it cannot be advanced further therein. Again, the natural tendency of the user is to release and terminate further inward pressure on clip 101. Leaf spring 143 again moves tab 106 outwardly when the inward pressure is released. Pin 137 follows along exit surface 132, and pin 137 enters exit track 124. This exit position is shown in FIG. 8. Force from spring 143 moves clip 101 out from recess 124 and into a protruding position. While, in the embodiment shown, pin 137 exits from portal 121 when clip 101 is in a protruding position, thereby possibly permitting clip 101 to be removed completely from housing 102, in other embodiments, it is possible to omit portal 121, such that clip 101 cannot be removed from housing 102.

Thus, a push-to-recess and push-to-protrude recessible integrated pocket clip for mobile devices and the like is provided. Tracks 123 and 124 can be relatively shallow, and pin 137 can be relatively short, so that latch components 111, 112 do not contribute significantly to the thickness of tab 106 and slot 108.

It should be understood that the various parts and components can be reversed. In its simple form, the latch mechanism described above includes tab-latch component 111 on tab 106 and slot-latch component within slot 108. In the first embodiment described above, one of the latch components, i.e., slot-latch component 111 in slot 108, is a track component. The other of the latch components, i.e., tab-latch component 111 on tab 106, includes follower 136, which is movable relative to the tracks in this embodiment. However, it should be understood that the latch components can be reversed, with the substantially fixed component located within slot 108 and the latch component translatable transverse to the axial direction positioned on tab 106. Still other variations and modifications are possible.

Figure 9:
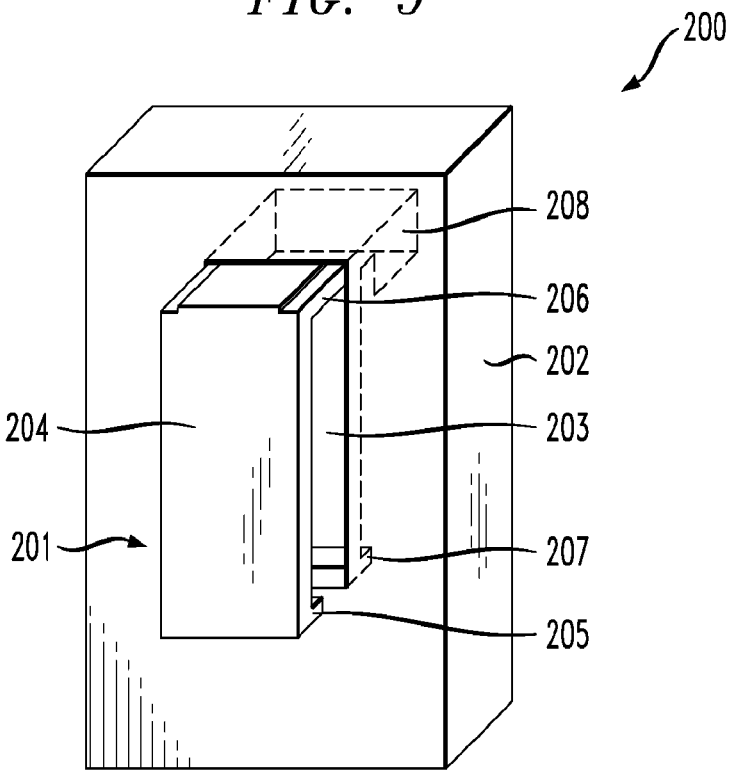
FIG. 9 is a perspective view of a mobile device including a recessible integrated pocket clip consistent with a second embodiment of the present invention, with broken lines showing the contours of a slot formed within the housing, for receiving and engaging the recessible integrated pocket clip.
Figure 10:
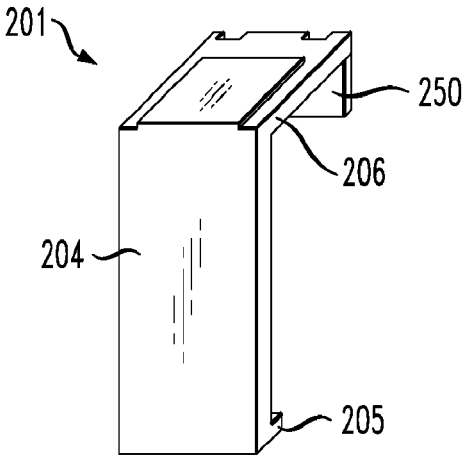
FIG. 10 is a perspective view of the recessible integrated pocket clip of FIG. 9.

FIG. 9 is a perspective view of a mobile device 200 including a recessible integrated pocket clip 201, consistent with a second embodiment of the present invention. Mobile device 200 has a housing 202 having formed therein a recess 203 adapted to receive clip 201, so that the outer face of the elongated portion 204 of clip 201 is flush with housing 202. Clip 201 has a hook 205 at a bottom end of elongated portion 204 and a tab 206 at a top end of elongated portion 204. The contours of recess 203 are formed to match the contours of clip 201. Accordingly, as shown in broken lines within housing 202, a bottom end of recess 203 is formed as a hook area 207 for receiving hook 205, and a top end of recess 203 is formed as a slot 208 for receiving tab 206.

Tab 206 is sufficiently smaller than the open area defined by slot 208 and is slidably disposed within slot 208 to permit clip 201 to travel between a position in which clip 201 is recessed within housing 202 and a position in which clip 201 protrudes from housing 202. The second embodiment is similar to the first embodiment (of FIG. 1 through FIG. 8), except that there is no latching mechanism or spring in the second embodiment, and clip 201 slides freely back and forth when a user pulls out or pushes in clip 201. Accordingly, in the second embodiment, a catch 250 is provided to prevent clip 201 from exiting housing 202 when fully pulled out.

Returning now to FIG. 1, a switch 109 or other activation mechanism can be provided, in certain embodiments of the invention, within slot 108, or elsewhere, to indicate to mobile device 100 whether the clip is in a recessed or protruding position. Such an indication can be used to control one or more functions of mobile device 100. For example, the mobile device 100 could be placed in a "sleep mode," a reduced-power state, or completely powered-down state, whenever clip 101 is in a recessed position. Alternatively, the indication from switch 109 can be used to activate or deactivate other functions of a mobile device. For example, if the mobile device is a mobile phone, the indication from switch 109 could be used to automatically change a ring-tone mode to a vibrate or silent mode. This feature could be used, e.g., when the user enters an auditorium or movie theater, removes the phone from a position in which the phone is clipped to the user's clothes, depresses the clip to cause the clip to be recessed, and puts the phone in the user's pocket.

Figure 11:
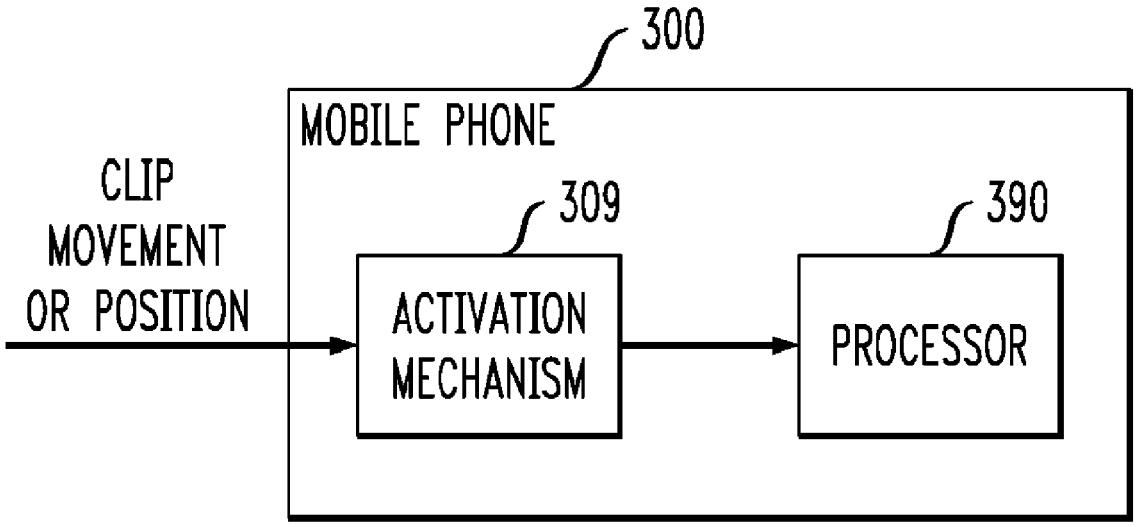
FIG. 11 is a block diagram of an exemplary mobile phone consistent with one embodiment of the present invention.

With reference to FIG. 11, a block diagram of an exemplary mobile phone 300 including a processor 390 and an activation mechanism 309 is shown. In this embodiment, instead of being a mechanical switch, activation mechanism 309 is a Hall-effect sensor mounted within the housing (not shown in FIG. 11) of mobile phone 300, which interacts with one or more permanent magnets or magnet arrays (not shown in FIG. 11) mounted on a recessible integrated pocket clip (e.g., element 101 in FIGS. 1 through 8; not shown in FIG. 11), to produce an output signal. This output signal, which could be a binary signal (e.g., a single-line interrupt to indicate either a fully-recessed or fully-protruding position of the clip), or alternatively, a variable signal indicative of how far the clip is recessed/protruding, is provided to processor 390 to control one or more functions of mobile phone 300. Processor 390 is adapted, upon receipt of the signal, to perform one or more predetermined functions, including, without limitation, volume or ring type change, or power reduction. Another possible function could be antenna selection, if mobile phone 309 has multiple transmit/receive antennas. In this scenario, when the clip is extended and mobile phone 309 is placed in a user's pocket, antenna diversity could automatically be disabled, such that a single outward-facing antenna is the only transmit/receive antenna active, while reception at the other antennas would be degraded because of the absorption of signals by the user's body. In embodiments where activation mechanism 309 is adapted to provide variable output signals, such signals could be pulse-code modulated (PCM) signals, which processor 390 decodes and uses to effect various functionality. Such variable output signals also permit tracking of the direction and/or speed of clip movement, which could have utility for various functions, such as enabling an audio-file (e.g., MP3) and/or video-file (e.g., MPG, AVI, WMV, 3GPP) play mode when the clip is "double-clicked" by two rapid consecutive presses or when the clip is pressed and held in a recessed position for a certain duration before being released to a locked position.

Instead of using a Hall-effect sensor for activation mechanism 309, a variable output signal could alternatively be provided by electromechanical means, such as an array of mechanical switches used to generate signals that are received and processed by processor 390.

Although the housing and clip components described above are desirably made of molded plastic, other materials are possible, and the housing, clip, and other related components can be made in various shapes and sizes. While a housing is generally described herein as a housing for a mobile device, it should be understood that the principles of the present invention are equally applicable to other items that might desirably include a recessible integrated pocket clip. Such items may include, e.g., eyeglass cases, purses, wallets, business-card holders, passport holders, nametag holders, photo ID holders, etc.

It should be understood that, although, in the embodiments described above, a recessible clip fits completely within a recess so that it is flush with a planar surface of the housing in a recessed or stowed-away position and extending from the housing in a protruding or usable position, other clip arrangements are possible in which a clip travels inward and outward with respect to the housing without the clip portion ever being completely recessed when in a stowed-away position or completely protruding when not in a stowed-away position. For example, in an embodiment in which the surface of the housing into which the clip is recessible has a non-planar surface, the contours of the clip may protrude to match the contours of that surface of the housing, and a portion of the clip may still protrude from the housing when the clip is in a recessed or stowed-away position. Alternatively, the clip could be recessible to a stowed-away position in which the outer surface of the clip is sunk below the outer surface of the housing.

The term "clip," as used in the embodiments described above, should not be construed as limiting the type of fastener that can be used as part of the present invention, and it is contemplated that fasteners other than clips could alternatively be used, such as, without limitation, a bolt, a buckle, a button, a catch, a clasp, a latch, a lock, a rivet, a screw, a zipper, a hook, a carabineer, a tie, hook-and-loop fastener, or a snap.

It will be further understood that various changes in the details, materials, and arrangements of the parts which have been described and illustrated in order to explain the nature of this invention may be made by those skilled in the art without departing from the scope of the invention as expressed in the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

We claim:

1. Apparatus comprising:

a housing having a recess formed therein;

a fastener, and a switch, wherein:

at least a portion of the fastener is adapted to fit within the recess;

the fastener is adapted to travel slidably within the recess between a first position in which the fastener enables the apparatus to be fastened to an external object and a second position in which the fastener is stowed away such that the at least a portion of the fastener is disposed within the recess;

pushing the fastener toward the recess and then releasing the fastener causes the fastener to alternate between being biased to remain in the first position and being biased to remain in the second position; and the switch is coupled to the fastener to control one or more functions of the apparatus based on whether the fastener is being biased to remain in the first position or being biased to remain in the second position.

2. The invention of claim 1, wherein the apparatus is a mobile device.

3. The invention of claim 2, wherein the one or more functions comprise reducing power to at least a portion of the mobile device.

4. The invention of claim 2, wherein the one or more functions comprise activating, deactivating, or changing a ring tone or a vibration function of the mobile device.

5. The invention of claim 2, wherein the one or more functions comprise enabling or disabling one or more antennas of the mobile device.

6. The invention of claim 2, wherein the switch is a Hall-effect sensor.

7. The invention of claim 2, wherein the switch provides a variable signal indicative of the distance of the fastener from either a recessed or a protruding position.

8. The invention of claim 7, wherein the switch provides signals indicative of the direction and/or speed of movement of the fastener.

9. The invention of claim 2, wherein the one or more functions comprise enabling or disabling an audio and/or video play mode.

10. The invention of claim 2, wherein the one or more functions are controlled by a predetermined number of successive movements of the fastener.

11. The invention of claim 2, wherein the one or more functions are controlled by holding the fastener in a predetermined position for a predetermined time duration.

12. The invention of claim 1, wherein the fastener is a clip.

13. The invention of claim 1, wherein:

the fastener has a tab;

the recess has a slot; and the slot is adapted to receive the tab slidably therein.

14. The invention of claim 13, wherein:

the tab has a tab-latch component;

the slot has a slot-latch component; and the tab-latch component and the slot-latch component cooperate to form a push-push mechanism enabling the fastener to move between the first and second positions.

15. The invention of claim 14, wherein the push-push mechanism comprises a generally heart-shaped pathway and a follower disposed within the pathway.

16. The invention of claim 1, wherein the entire fastener is adapted to fit within the recess while in a stowed-away position.

17. The invention of claim 1, further comprising a biasing mechanism adapted to bias the fastener in a direction away from the recess.

18. The invention of claim 1, further comprising a catch adapted to prevent the fastener from being fully removed from the housing.

* * * * *